US007207745B2

(12) United States Patent
Goossens

(10) Patent No.: US 7,207,745 B2
(45) Date of Patent: Apr. 24, 2007

(54) DEVICE FOR LEVELLING OF POURED FLOORS, IN PARTICULAR CONCRETE FLOOR

(75) Inventor: Benny Goossens, Tessenderlo (BE)

(73) Assignee: Full-Track Belgium BVBA, Zoutleeuw (NL)

( * ) Notice: Subject to any disclaimer, the term of this patent is extended or adjusted under 35 U.S.C. 154(b) by 399 days.

(21) Appl. No.: 10/433,214

(22) PCT Filed: Nov. 30, 2001

(86) PCT No.: PCT/BE01/00203

§ 371 (c)(1),
(2), (4) Date: Nov. 6, 2003

(87) PCT Pub. No.: WO02/44498

PCT Pub. Date: Jun. 6, 2002

(65) Prior Publication Data

US 2004/0076470 A1 Apr. 22, 2004

(30) Foreign Application Priority Data

Nov. 30, 2000 (BE) ..... 2000/0763

(51) Int. Cl.
*E01C 19/22* (2006.01)

(52) U.S. Cl. ..... 404/112

(58) Field of Classification Search ..... 404/112
See application file for complete search history.

(56) References Cited

U.S. PATENT DOCUMENTS

| | | | | |
|---|---|---|---|---|
| 2,888,863 | A * | 6/1959 | Eisenbeis | 404/112 |
| 3,756,551 | A * | 9/1973 | Bishop | 267/141.1 |
| 3,973,857 | A * | 8/1976 | Whiteman, Jr. | 404/112 |
| 4,320,986 | A * | 3/1982 | Morrison | 404/112 |
| 4,629,359 | A * | 12/1986 | Sengupta | 404/112 |
| 4,676,691 | A * | 6/1987 | Morrison | 404/112 |
| 5,102,258 | A * | 4/1992 | Berger | 404/97 |
| 6,019,545 | A * | 2/2000 | Allen et al. | 404/112 |

FOREIGN PATENT DOCUMENTS

EP 0 887 489 A1 12/1998

* cited by examiner

*Primary Examiner*—Gary S. Hartmann
(74) *Attorney, Agent, or Firm*—The Webb Law Firm

(57) ABSTRACT

A device for levelling a recently poured floor is disclosed wherein the device substantially comprises a frame with a drive motor, the drive shaft of which stands upright, and a rotor connected to the shaft and having two or more blades which are directed radially relative to the shaft and each of which can be placed at an angle relative to the shaft, wherein an annular support member is arranged concentrically round the drive shaft and is pivotally connected to each blade at a distance from the shaft such that a rotation of the ring brings about an equal and simultaneous tilting of each blade.

3 Claims, 2 Drawing Sheets

DEVICE FOR LEVELLING OF POURED FLOORS, IN PARTICULAR CONCRETE FLOOR

BACKGROUND OF THE INVENTION

The invention relates to a device for levelling a recently poured floor, in particular a concrete floor, which device substantially comprises a frame with a drive motor, the drive shaft of which stands upright, and a rotor connected to the shaft and having two or more blades which are directed radially relative to the shaft and each of which can be placed at an angle relative to the shaft, and an annular support member which is arranged concentrically round the drive shaft and is pivotally connected to each blade at a distance from the shaft such that a rotation of the annular support member brings about an equal and simultaneous tilting of each blade.

Such a device is used to smooth the surface of, in particular, poured concrete floors, for which purpose the polishing blades of the rotor are rotated at a determined rotation speed, which polishing blade can have a determined pre-adjustable angle relative to the rotation axis. Known devices of this type have the drawback that the adjustment of the angle of each polishing blade relative to the rotor shaft must be embodied in quite complicated manner. This requires much time, and therefore loss of production.

The invention has for its object to obviate the above stated drawbacks and provides for this purpose a device which is distinguished in that the annular support member is provided with a shock absorber in the pivot with a rotorarm.

Owing to the common support ring of the polishing blades, not only is a simultaneous angular adjustment of the polishing blades ensured, but the ring also provides some support of the blades at a distance relative to the rotation axis. Excessive undesired vibrations are hereby prevented, by damping the vibrations, whereby a better final levelling result is realized.

In order to adapt the machine in simple manner to the diverse finishing processes depending on the type of floor, it is recommended to mount the polishing blades exchangeably on a rotor arm. This exchange capability can take place by means of clamping means such that the blade can be released and a new blade can be mounted using a simple screwed connection.

In this embodiment it is recommended to arrange each rotor arm with one end for rotation in a bush of a carrier connected to the shaft, which arm is provided with an adjusting plate with adjustable stop.

The desired angular adjustment of the blades is achieved in simple manner owing to this stop.

Above mentioned and other features of the invention will be elucidated in the figure description below of an embodiment. In the drawing.

Figure 1:
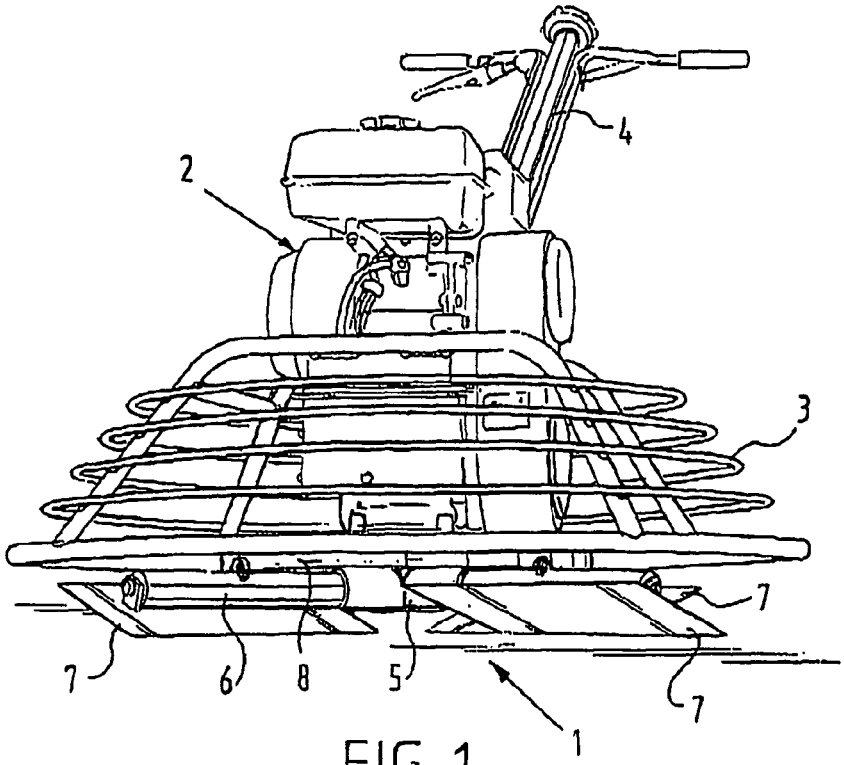
FIG. 1 shows a perspective elevated view of the device according to the invention.

The device shown in FIG. 1 comprises a frame 1 with a motor 2 placed thereon, wherein the device is also provided with a safety cage around the motor which projects over the operating range of the group of polishing blades placed thereunder, whereby the user is not struck by the rapidly rotating polishing blades.

By means of a handle with control means the device can be moved back and forth by the user over a recently poured floor in a predetermined pattern, this not being further elucidated here since it is deemed known by the skilled person.

Figure 2:
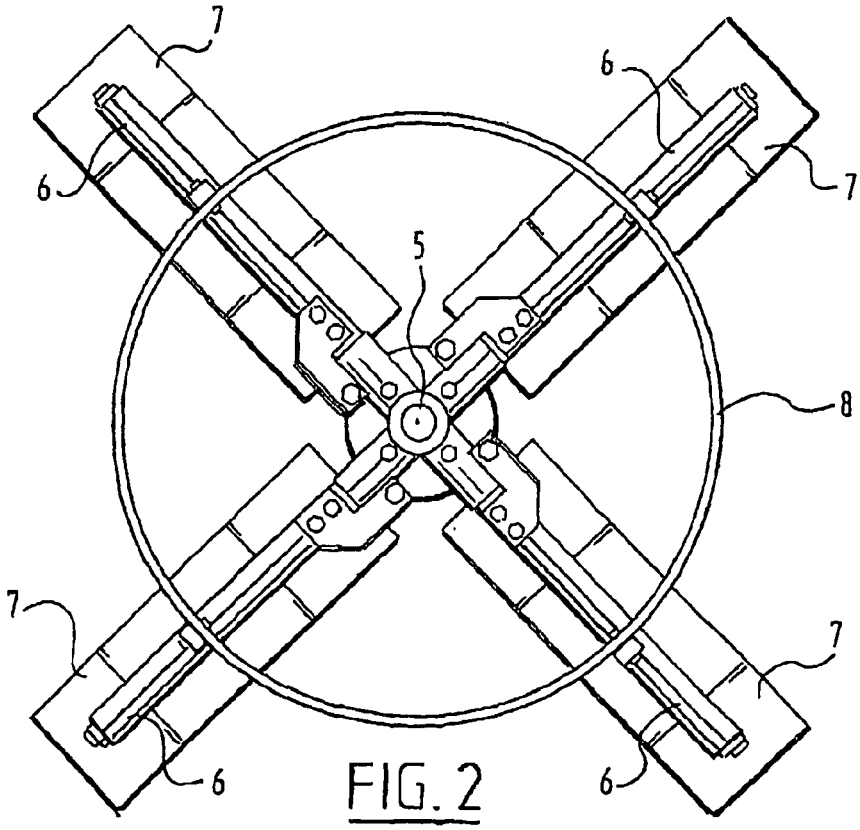
FIG. 2 shows a top view of the rotor with polishing blades as applied in the device of FIG. 1.

Rotor 5 is shown in top view in FIG. 2, and consists of a central hub part or rotor holder 5 which is embodied with a number of bush-shaped protrusions, the number of which corresponds with the number of polishing blades used.

The holder can be mounted in known manner on the vertically standing motor shaft such that a torque can be transmitted onto the rotor from the motor.

Each polishing blade is provided with a rotor arm 6 on which the polishing blade 7 can be mounted exchangeably, this being further elucidated hereinbelow.

Arranged concentrically round the central shaft of carrier 5 is an annular support member 8 which also serves as support ring for arms 6 and therefore polishing blades 7, since the diameter of annular member 8 is such that the polishing arms are supported about halfway along their length.

Figure 3:
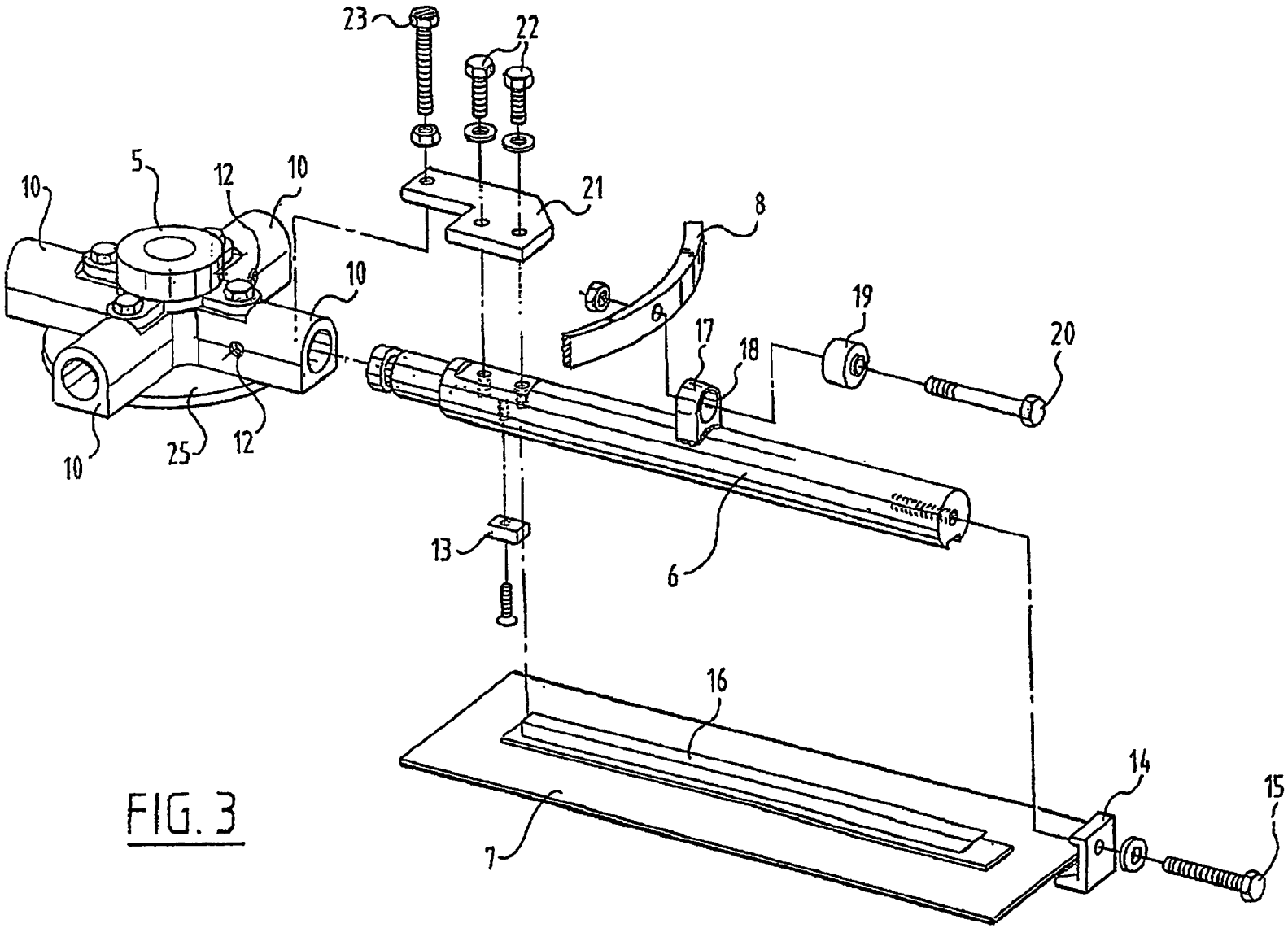
FIG. 3 shows a perspective top view of a part of the rotor provided with rotor arms and polishing blades, in exploded assembly.

Referring to FIG. 3, in which the same reference numerals are used for the same components, each rotor arm 6 has a pin-shaped end part 9 which can be placed into the bush-like protrusion 10 of holder 5. A rotating movement of rotor arm 6 around its central axis is hereby possible. End part 9 is provided with a peripheral groove 11 in which a pin, which can be inserted into a pin hole 12 of protrusion 10, is axially placed so that rotor arm 6 is received rotatably but not displaceably in the hole of protrusion 10.

The rotor arm is provided with a block 13 which is attached fixedly to the underside of rotor arm 6 by means of bolts or the like, as well as a clamping part 14 which can likewise be fixed against the end face of rotor arm 6 by means of bolt 15, such that a ridge 16 of polishing blade 7 can be received and fixed between clamping means 13, 14. In this manner the polishing blade 7 can be released easily from the rotor arm by loosening bolt 15, and a new blade can be fixed in simple manner by tightening bolt 15.

On the side of rotor arm 6 remote from the polishing blade is arranged a block 17 provided with a hole 18 in which a rubber bush 19 can be placed, in which bush a bolt 20 can be placed into a threaded hole of ring 8. Rubber bush 19 herein serves as vibration or shock damper.

Fixed by means of bolts 22 on the end of rotor arm 6 directed toward holder 5 is an adjusting plate 21 which is provided with an adjustable stop screw 23 which can be placed in a hole 24 of plate 21. This bolt is supported on a disc 25 of holder 5, this such that by rotating the rotor arm 6 the end part of bolt 23 moves against disc 25, and therefore adjusts a determined angle of polishing blade 7 relative to the rotation axis.

The simultaneous adjustment of all polishing blades with their rotor arms 6, each of which is arranged in a protrusion of rotor 5, enables simultaneous adjustment of all polishing blades at the same angle relative to the rotation axis.

The invention is not limited to the above described embodiment. Polishing blade 7 can thus be arranged rotatably on a fixed rotor arm 6, wherein ring 8 is then coupled directly to polishing blades 7.

The mounting of polishing blade 7 on rotor arm 6 by means of the ridge 16 and clamping means 13, 14 can also be embodied in any suitable manner, for instance by means of direct arranged screw bolts.

It is also possible for two rotors to be applied per device instead of the single rotor machine according to FIG. 1.

The invention claimed is:

1. A device for levelling a recently poured floor, which device comprises a frame with a drive motor having a drive shaft which stands upright, a rotor connected to the drive shaft and having two or more blades which are directed radially relative to the drive shaft and each of which can be placed at an angle relative to the drive shaft, and an annular support member which is arranged concentrically round the drive shaft and is pivotally connected to each blade at a distance from the drive shaft such that a rotation of the annular support member brings about an equal and simultaneous tilting of each blade, and wherein the annular support member is provided with a shock absorber in the pivot with a rotor arm.

2. The device as claimed in claim 1, wherein each blade is mounted exchangeably on the rotor arm using clamping means.

3. The device as claimed in claim 2, wherein each rotor arm is arranged with one end for rotation in a bush of a carrier connected to the shaft, which arm is provided with an adjusting plate with adjustable stop.

* * * * *